US006530472B2

(12) United States Patent
Hacikyan

(10) Patent No.: US 6,530,472 B2
(45) Date of Patent: Mar. 11, 2003

(54) SHIPPING CONTAINER WITH ANTI-LEAK MATERIAL

(75) Inventor: Michael Hacikyan, Williamsville, NY (US)

(73) Assignee: Technicor, Inc., Amherst, NY (US)

( * ) Notice: Subject to any disclaimer, the term of this patent is extended or adjusted under 35 U.S.C. 154(b) by 0 days.

(21) Appl. No.: 09/916,805

(22) Filed: Jul. 27, 2001

(65) Prior Publication Data

US 2001/0050237 A1 Dec. 13, 2001

Related U.S. Application Data

(63) Continuation-in-part of application No. 09/558,982, filed on Apr. 27, 2000.
(60) Provisional application No. 60/184,917, filed on Feb. 25, 2000.

(51) Int. Cl.[7] ..... B65D 81/26

(52) U.S. Cl. ..... 206/204; 206/524.5
(58) Field of Search ..... 206/204, 523, 206/524.5; 383/63, 84, 94, 109, 110, 113

(56) References Cited

U.S. PATENT DOCUMENTS 4,969,750 A * 11/1990 Russo et al. ..... 383/113
5,199,795 A * 4/1993 Russo et al. ..... 383/113

* cited by examiner

*Primary Examiner*—Luan K. Bui
(74) *Attorney, Agent, or Firm*—Hodgson Russ LLP

(57) ABSTRACT

A safety container for shipping or storing vials containing hazardous liquids. The container is constructed of a liquid impermeable outer layer and an interior layer that is embedded with a super absorbent polymer that will immobilize and stabilize any fluid that leaks from the vial. The container has an opening through which the vial is inserted which is sealed prior to shipment.

4 Claims, 5 Drawing Sheets

SHIPPING CONTAINER WITH ANTI-LEAK MATERIAL

The present patent application relies on the priority of U.S. Provisional Patent Application serial No. 60/184,917, filing date of Feb. 25, 2000; and is a continuation-in-part of patent application Ser. No. 09/558,982 filed Apr. 27, 2000.

FIELD OF THE INVENTION

The present invention relates to a shipping container for hazardous or other fluids by using a super absorbent polymer such as a polyacrylate material that will immobilize a leaking fluid if contacted thereby and form an expanding gel that will stabilize the container and its contents.

BACKGROUND OF THE INVENTION

Prior attempts to control leaking materials have been disclosed in U.S. Pat. No. 4,749,600 (Inventors: Cullen et al.). Cullen discloses a packet for absorbing and immobilizing a liquid. The packet looks like a sugar packet (See FIG. 3 of the '600 patent) and has an outer layer and inner contents. When the packet is to be used, it is inserted within an outer container, like a Federal Express package. In many instances, the packet falls to the bottom edge, in particular a corner, of the outer container. See Col. 2, lines 46 of the '600 patent. Along with the packet, an inner container of a liquid, like a test-tube of blood (See FIG. 5 of the '600 patent) is inserted into the outer container. According to the '600 patent, the bottom edge of the inner container should contact the packet. Thus, when the blood spills from the inner container, the blood may, or may not contact the packet if the packet has moved. During shipping, packages do not always remain in their upright position.

If the blood or other liquid contacts the packet, the blood dissolves the outer layer. The packet has an inner layer of polyvinyl acetate and an outer layer of starch paper or any other liquid-degradable material. The polyvinyl acetate is the inner layer in order for the packet to be formed. See col 2, lines 9–11 of the '600 patent.

When the outer layer dissolves, the inner contents are released and form a gel-like substance by absorbing the blood. The inner content is sodium polyacrylate having the formula (C3H3O3Na)n. It is obtainable under the trademark WATER LOCK J-550 from Grain Processing Corporation.

One problem with the Cullen's attempt to immobilize a liquid is that the packet is small and it is possible that the liquid may never make contact. For example, if the packet is located at the bottom of the outer container, as Cullen suggests, and the liquid leaks to the top of the outer container or the container falls on its sidewall, the packet may never immobilize the liquid since the liquid may never contact the packet. Therefore, the liquid can spill from the outer container and provides little protection to the handler of the package. These results can be deleterious to the handler. For example, if the liquid is HIV contaminated or otherwise infectious, and that liquid contacts a cut on the handler, that handler could become infected.

Reference should be made to U.S. Pat. Nos. 6,161,687 and 5,984,087, assigned to Technicor, Inc.—the owner of this application. In these patents, the invention "relates to a packaging container designed to transport an inner container containing a liquid. The packaging container has a first water soluble film or layer and an absorbent material. The inner layer of the packaging container is the water-soluble film that forms the boundary between the cavity that holds the inner container and the packaging container. When the liquid leaks from the inner container while in the packaging container, the liquid penetrates through the water-soluble film. When the liquid pentrates there through, the absorbent material absorbs, adsorbs and immobilizes the liquid material. This immobilization prevents the liquid from escaping from the packaging container.

SUMMARY OF THE INVENTION

A safety container for shipping or storing vials containing hazardous liquids. The container is constructed of a liquid impermeable outer layer and an interior layer that is embedded with a super absorbent polymer that will immobilize and stabilize any fluid that leaks from the vial. The container has an opening through which the vial is inserted which is sealed prior to shipment.

DETAILED DESCRIPTION OF THE INVENTION

Figure 1:
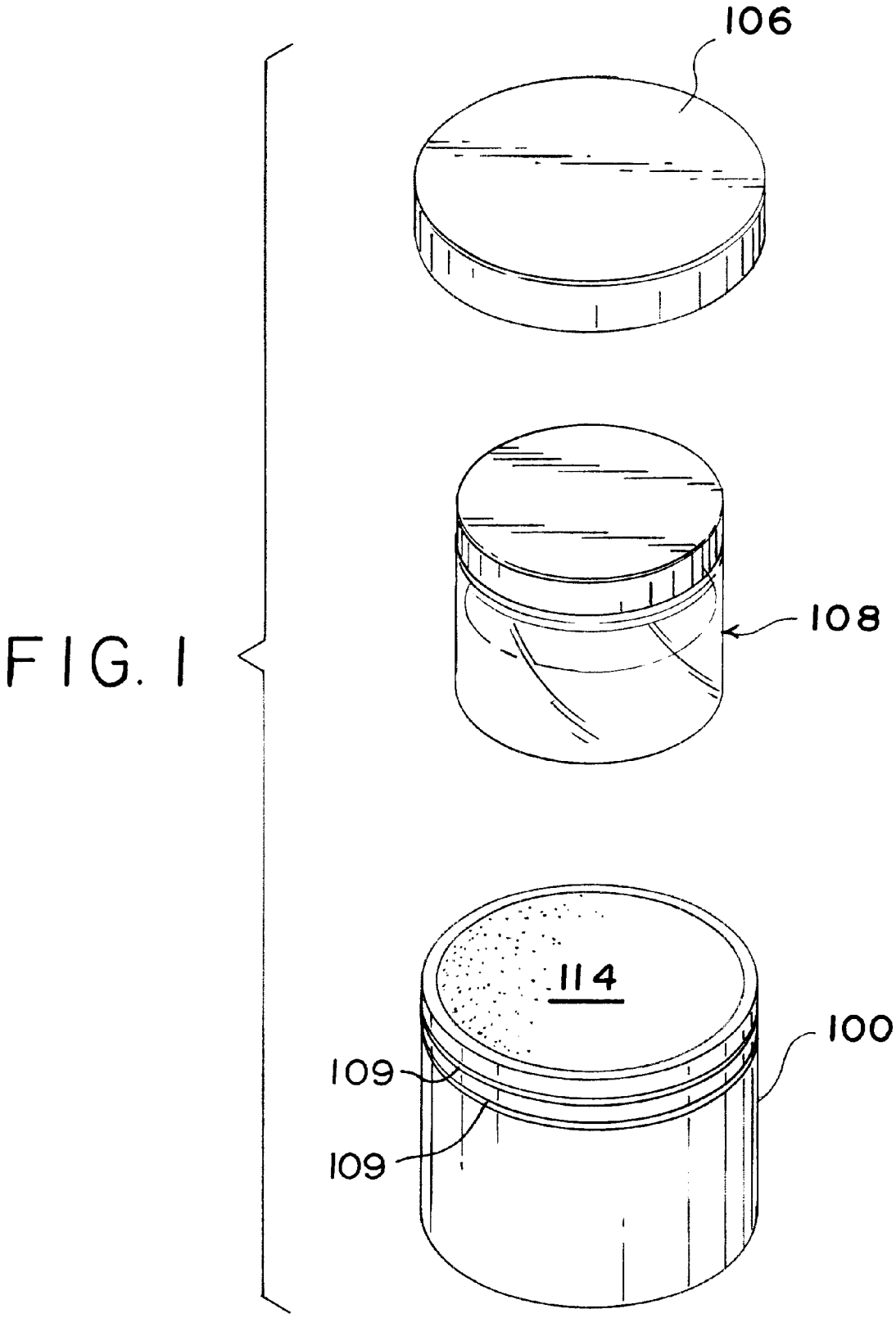
FIG. 1 is an exploded perspective of one form of the invention.

The present invention relates to packaging units where the absorbent surrounds an inner liquid-containing vial and a liquid impermeable product surrounds the absorbent. If there is leakage the liquid contacts the absorbent/adsorbent material and the absorbent/adsorbent material immobilizes the liquid, transforms the liquid to a gel, and the gel expands throughout the shipping container. The gel prevents the liquid from leaking from the confines of the container. By circumscribing the vial with the super absorbent polymer, leakage from the container is prevented whether the container is upright, on its side or upside down.

In hard-shell embodiments described herein, leakage is likely to occur from the liquid-containing vial because of breakage or if one of the handlers carelessly secures the cap to the vial so the cap is loosely attached to the vial. In the flexible embodiment leakage is also likely to occur for the same reasons. In either case, a principle objective of this invention is to prevent leakage from the outer container and to reduce the risk to any handler along the shipping route as well as those at the reception station. This protection is gained by the super absorbent polymer such as sodium polyacrylates and its capacity to bind the hazardous substance in a gel that will prevent leakage, reduce any chance of infection by a handler, and because of its elasticity, stabilize the position of the vial in the outer container.

The drawings are partially diagrammatic and certain dimensions thereof have been accentuated in order to better illustrate construction and operation. For instance, the vials for inner containers might be larger or smaller than that shown. The vials shown are representative in size but have been chosen primarily to leave enough room to show the expansion feature of the polyacrylate super absorbent polymer and how it reacts if a breakage or leakage occurs in the vial containing the hazardous or dangerous substance.

Referring now to the drawings wherein like numerals refer to like parts, the numeral 100 indicates a shipping container. In the embodiment of FIGS. 1–5 the container 100 is cylindrical and includes an impermeable sidewall 102 and a bottom 104. The container has an open top 105 enclosed by a closure such as a cap or lid 106. The lid 106 can be threaded, friction-fitted, or formed with a rail 107 on the lid with matching grooves 109 on the container. The lid 106 can also be tamper evident. Whatever style, the lid 106 must be of a type capable of safety sealing the container. The container 100 is adapted to ship or store a vial 108 that will oftentimes contain a liquid substance such as blood, urine or other bodily fluids and/or fluid hazardous substances (hereinafter "liquid" or "liquid substances"). The inner container 108 (the primary receptacle) is referred to as a vial for ease of description. When the word "vial" is used herein, it is used generically to include any storage unit for liquid substances including the aforementioned Hazardous substances which sometimes are bodily fluids.

Figure 2:
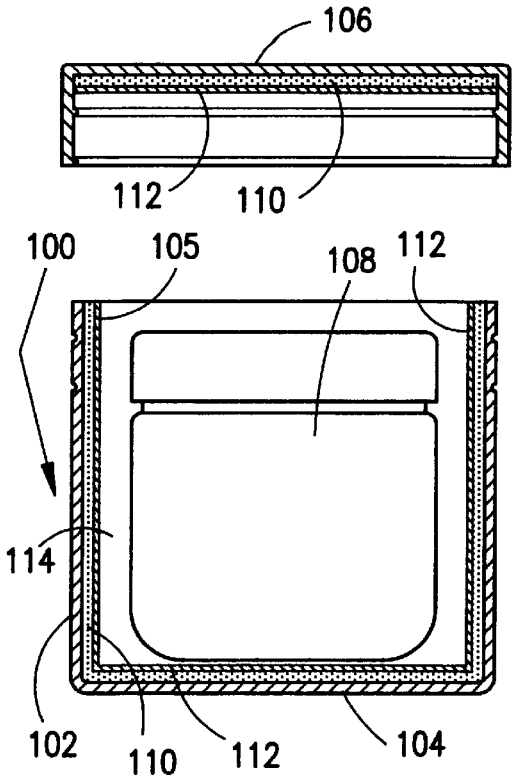
FIG. 2 is a diagrammatic cross section of the assembled elements of FIG. 1 showing the vial in elevation and the shipping container in cross section.

In the embodiment of FIG. 2, the interior of container 100 is lined with a layer or lining 110 (a laminate) that is impregnated throughout with a super absorbent polymer such as sodium polyacrylate. The layer 110 can be a woven fabric or a paper product. It can be made of any material that is somewhat porous and is capable of receiving and storing a super-absorbent product. In construction, there is sufficient polyacrylate in layer or lining 110 to absorb completely the liquid in vial 108. A second lining or coating 112 covers the layer 110. The coating or lining 112 is fluid soluble, fluid permeable or a fluid degradable material. Lining 112, the bottom 104 and the cap 106, form a cavity 114 to receive the vial 108. Vial 108 is not cross-sectioned.

The invention described herein utilizes and captures the unique characteristics of polyacrylates for shipping liquid substances. These characteristics will not only prevent escape if there are leaks from the primary receptacle, but provide safety measures because of the manner the fluid is absorbed, adsorbed or bound. Super absorbents such as sodium polyacrylate will not only absorb many times its own weight of liquid but they also form a gel that binds the liquid to itself without a chemical reaction. Further, the resulting gel is elastic and is many times the volume of the polyacrylate and liquid themselves. This provides an expansion or swelling that stabilizes and immobilizes any escaping liquid from the vial as well as stabilizing the position of the vial with an elastic, cushion-like material.

If leaking from vial 108 occurs, these polyacrylate characteristics cause the space between the vial 108 and the interior of the container to be filled, or at least partially filled, with a gel 116 that will not only immobilize any leakage but will hinder the movement of the vial 108 by cushioning the vial so that further leakage is reduced. The gel 116 binds or locks the leaking fluid to itself to reduce the chance for inadvertent exposure of fluid substances, like hazardous fluid, to handlers. The gel will not permit blood, urine, or other such substance from migrating by mere touch or handling. Gauze, cotton or other like absorbents merely absorb the fluid. The fluid is readily released from these types of absorbing substances if squeezed, pressed or even touched.

The lining 112 is a protective layer that will not restrict a leaked liquid from reaching the polyacrylate layer 110 so that the latter can absorb and expand throughout the cavity between the vial and the container as shown. Layer 112 must be permeable, soluble or degradable. When the term "degradable" is used herein, it refers to permeable, soluble or any material that will not interfere with a leaking liquid reaching the absorbent layer 110.

Figure 3:
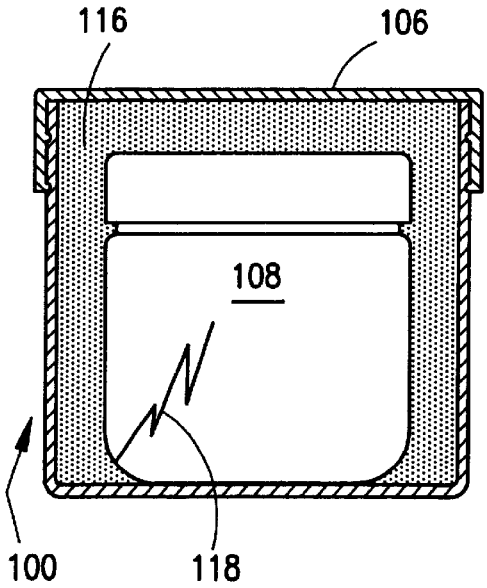
FIG. 3 is a diagrammatic view of FIG. 2 after a leak or crack occurs in the vial
Figure 5:
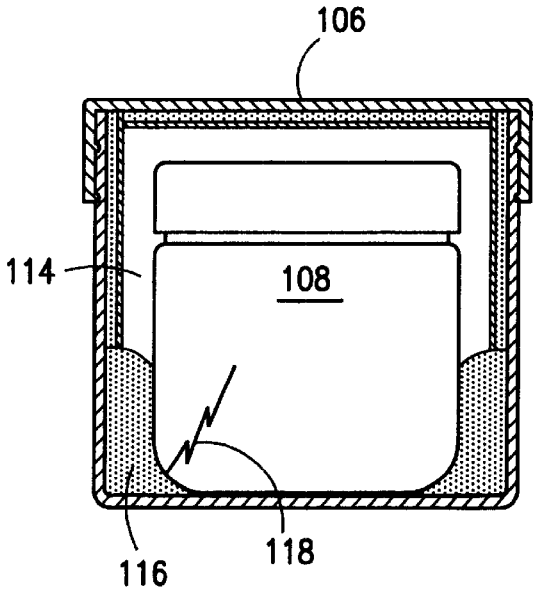
FIG. 5 is a view of FIG. 4 showing operation of the FIG. 4 embodiment.

FIG. 3 is a partial cross-section disclosing how the gel 116 will fill the container cavity 114 if a leak from the vial occurs through a crack 118 or the like. The amount of polyacrylate in layer 110 is always sufficient to absorb the amount of liquid in vial 108.

Figure 4:
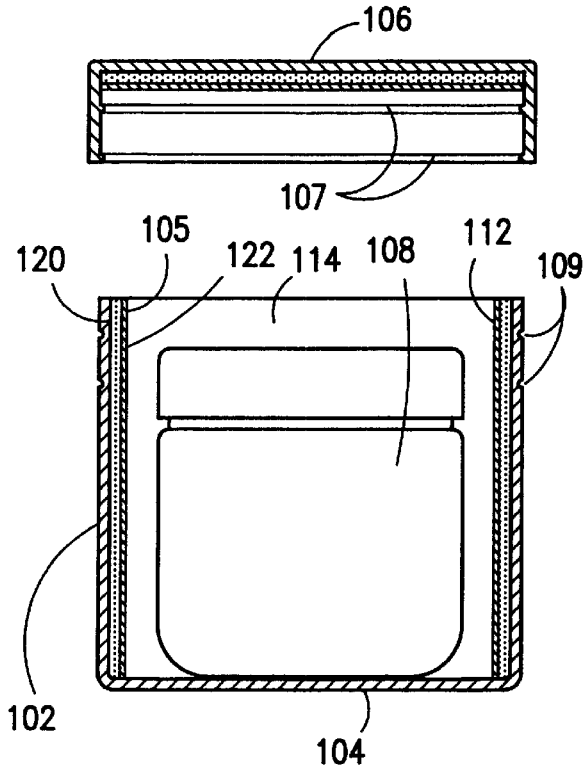
FIG. 4 is a diagrammatic cross-section showing another embodiment of the invention.

In the embodiment of FIG. 4 there is no absorbent layer or degradable layer on the bottom 104. However, a cylindrical absorbent layer 120 and an inner cylindrical degradable layer 122 are disclosed. These layers extend from top to bottom but not across the bottom. If fluid leakage occurs, for instance from the lid area or a crack in the vial, the fluid will seek the bottom of the container if the container is in its upright position. The gel migrates upwards about the periphery of the vial as the super-absorbent turns the leaking liquid into a gel. This aids in cushioning the vial uniformly about its periphery. See FIG. 5. As shown, note that layers 120 and 122 disappear as the gel forms. If the super absorbent layer 122 is embedded in non-soluble mesh, the mesh, of course, will remain after the super absorbent leaves the mesh to form a gel with the liquid. If sufficient fluid is leaked the entire cavity will be filled as shown in FIG. 3. If only a small amount of fluid is leaked, the entire cavity will not be filled.

FIGS. 1 through 5 disclose a hard shell or canister type-shipping container. As described above, these containers have linings to prevent fluid escape in the event of leakage from the primary container. Many advantages of this invention can also be obtained in flexible containers. In FIGS. 6 through 11, an embodiment is shown that utilizes a flexible outer shell or envelope that is readily constructed and is adequate to ship and store smaller primary receptacles or vials.

Figure 6:
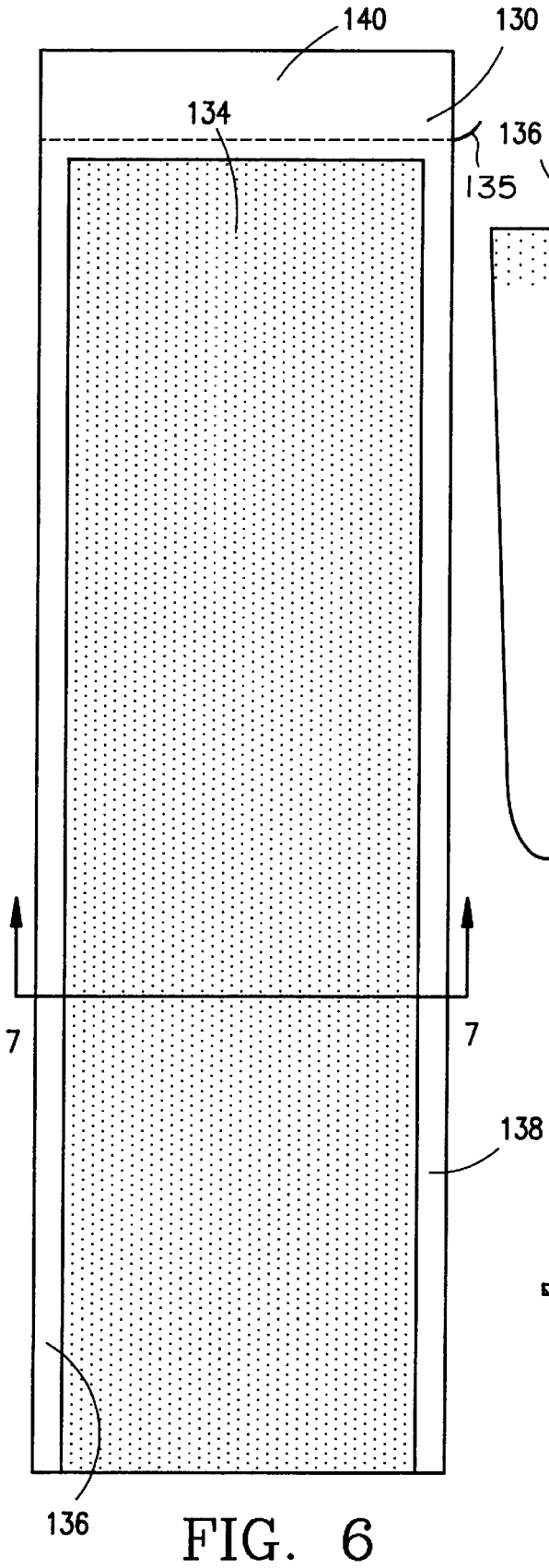
FIG. 6 is a plan view of a principle element of a flexible embodiment of this invention prior to its assembly.

A water impermeable layer 130 of polyethylene Tyvek (a DuPont trademark) which is a puncture resistant material, or other films such as polyester, polyethylene, polypropylene or the equivalents thereof is shown in FIG. 6. This layer 130 is also the outer surface for this embodiment. The layer 130 has two additional layers or linings applied thereto. An absorbent layer 132 containing a super-absorbent such as sodium polyacrylate is applied directly to layer 130. The layer 132 can be secured to the layer 130 by an adhesive or just applied to the layer 130, depending on the application. Over the polyacrylate layer 132 is a protective, liquid degradable, layer or liner 134. See FIG. 7.

The layers or linings are applied so that borders or edges 136 and 138, along the longitudinal sides of sheet 130, are exposed and do not receive the coatings 132 and 134. At one end of the sheet 130, a closing flap 140 is provided. A tear strip 135 is provided on sheet 130 just above the coating 134.

Figure 8:
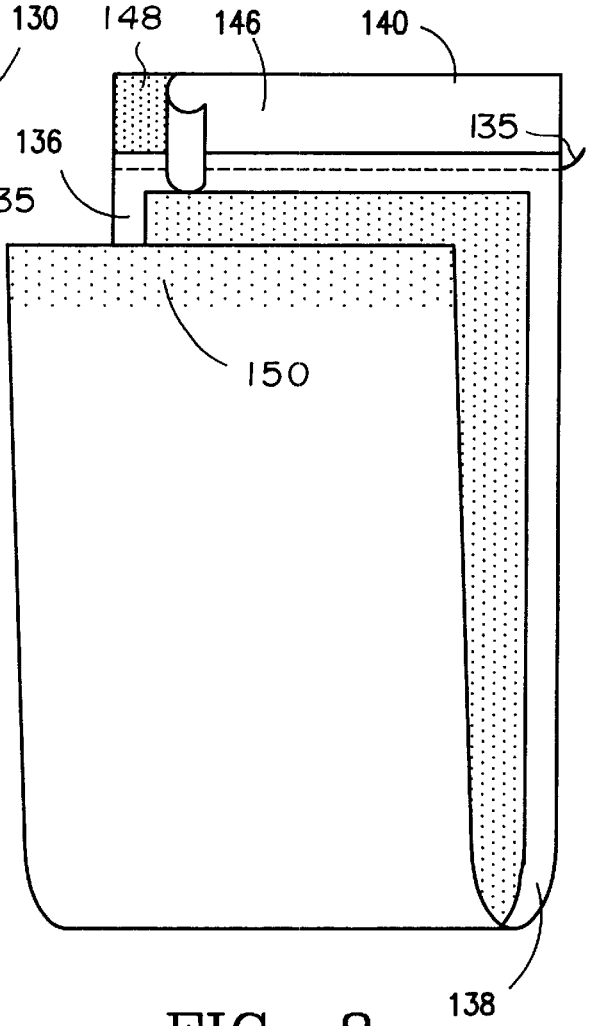
FIG. 8 depicts an initial stage of assembly of the FIG. 6 product.
Figure 10:
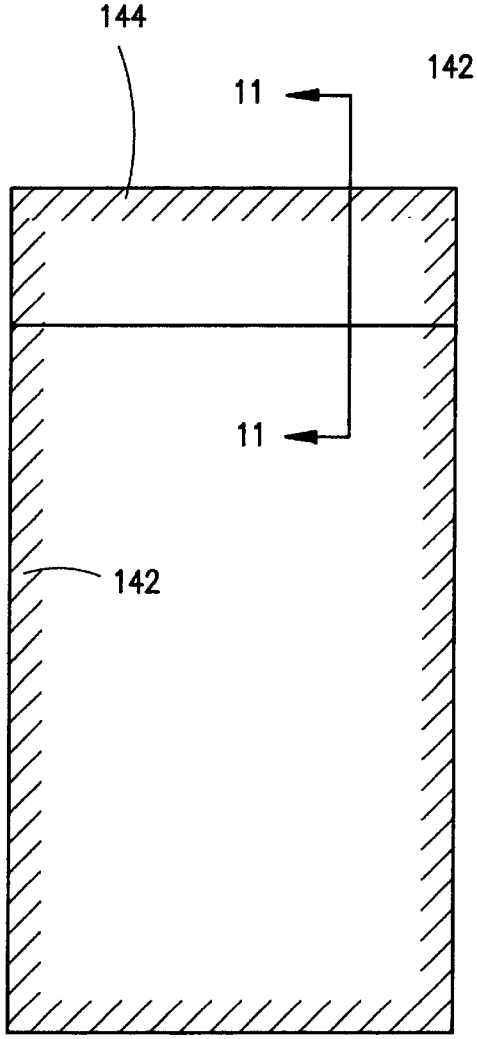
FIG. 10 is the assembled flexible container of FIGS. 6–9 ready for shipment.
Figure 9:
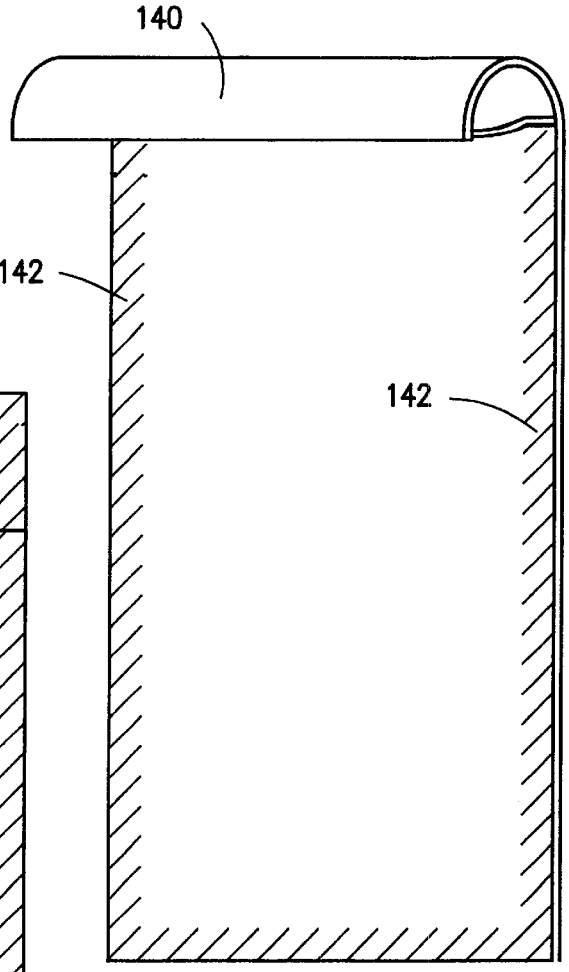
FIG. 9 depicts the next stage of assembly of the FIG. 6 product with the shipping vial contained within the container.
Figure 11:
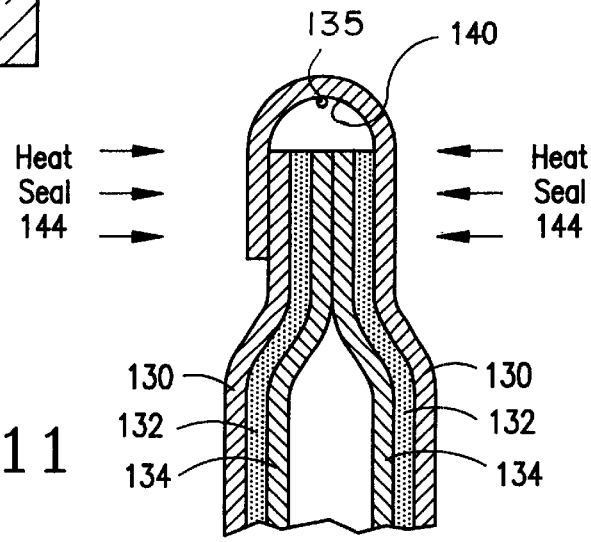
FIGS. 11–11*a* is a cross-sectional view of FIG. 10 taken along the line 11—11.

The embodiment shown in FIG. 6 is folded upon itself. The initial stage of this folding is shown in FIG. 8. Upper and lower portions of edges 136 and 138 are folded against themselves and heat-sealed, glued, sonically welded or otherwise secured, as depicted by the dash mark 142 as shown in FIGS. 9 and 10. A vial 108 is placed in the container through opening 143 and the flap 140 forms a closure that is folded over the upper outside portion of layer 130 as seen in FIG. 9. FIG. 10 shows the completed sealed container. FIG. 11 is a partial enlarged cross-sectional view of the layers in the assembled package in the flap or closure vicinity. The flap end of the envelope is also heat-sealed at 144 when necessary. This provides a sealed periphery.

A peel-off strip 146 is provided to cover adhesive 148. One can also coat the exterior of sheet 130 with an adhesive as shown by numeral 150. An adhesive 150 can be used in lieu of the 146/148 heat sealed combinations or in cooperation therewith. After sealing the package can be opened by pulling on the tear strip 135.

As can be understood, the working and operation of the flexible embodiment of FIGS. 6–11 will function in a similar manner as the hard-shell embodiment of FIGS. 1–5. If a leakage occurs from the vial, the super absorbent in layer 132 will gel with the liquid and fill the cavity if sufficient fluid has leaked.

Figure 7:
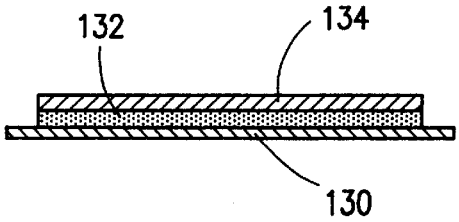
FIG. 7 is a cross-sectional view of FIG. 6 taken along the line 7—7.
Figure 11A:
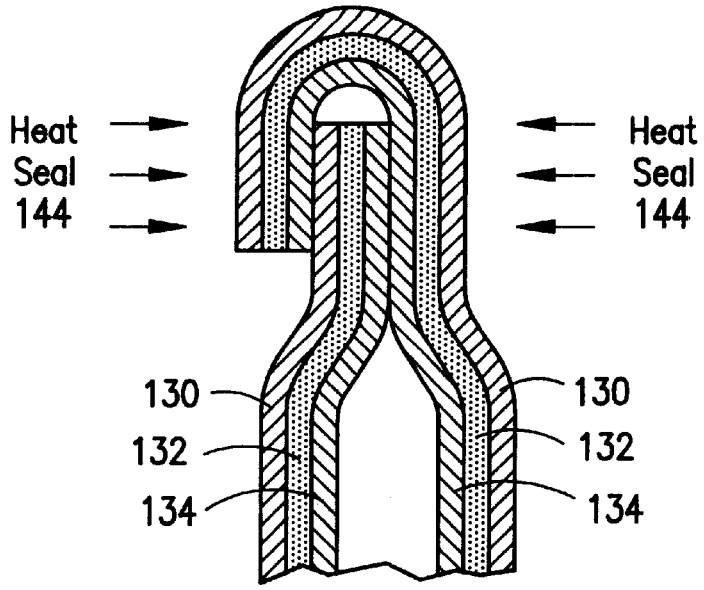

FIG. 11 is a lateral cross-section of the embodiments illustrated in FIGS. 6–8 after sealing. FIG. 11*a* is a similar cross-section of the sealed container when the layers 132 and 134 extend to the entire length of the carrier member 130.

Figure 12:
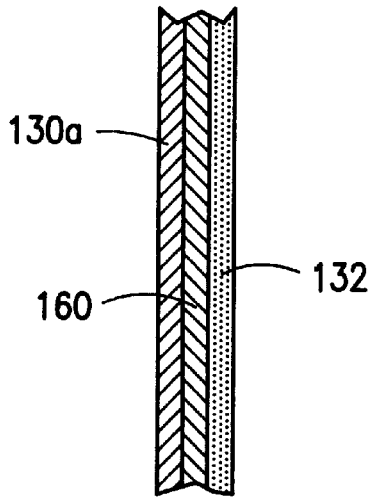
FIG. 12 is a diagrammatic cross-section of a flexible container wherein the cushioning foam layer is added.

In FIG. 12 there is shown a cross-section of a wall-section wherein the base layer 130*a* is Tyvek (a trademark of DuPont) or other polyester equivalent. These plastics are very resistant to puncture and tearing. In all the embodiments a foam or cushioning liner 160 can be employed between the outer layer and the adsorbent/absorbent layer 132 as shown in FIG. 12.

Figure 13:
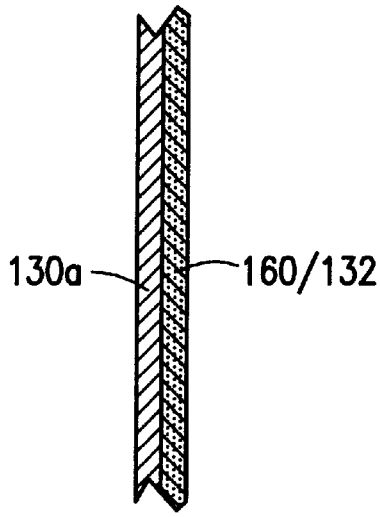
FIG. 13 is a diagrammatic cross section of a portion of the container with a thick absorbent laminate to house the super absorbent and provide cushioning.

In FIG. 13 there is shown a cushioning layer 160 that carries the super absorbent itself.

In the drawings and specifications both the preferred and alternative embodiments of the invention have been disclosed. Other embodiments and uses for the present invention will be readily apparent to those skilled in the art intended to fall within the scope of this invention. Therefore the disclosures and descriptions are to be taken as illustrative and are not intended to be limiting.

I claim:

1. A container for receiving a vial that contains a first liquid therein comprising:

a cylindrical sidewall having a first end and an open end;

a bottom enclosing the first end of the sidewall;

a removable lid for enclosing the open end of the sidewall and defining a cavity with the sidewall and the bottom;

the sidewall, the bottom and the removable lid providing a substantially rigid housing that is impermeable to liquids;

a lining coating the inner surface of the housing and surrounding the cavity and the lining containing a super-absorbent material that is sufficient in volume to absorb all of the liquid in the vial and expansive enough to fill the cavity with a gel when the liquid from the vial contacts therewith;

the open end providing the means by which the vial can be inserted into the cavity; and the removable lid having an interior layer that comprises part of the lining.

2. The container of claim 1 wherein the cavity is further enclosed by a liquid permeable layer interiorly located of the lining.

3. The container of claim 1 wherein the lining is a woven fabric.

4. The container of claim 1 wherein the lining is water-soluble paper.

* * * * *